United States Patent [19]

Henrie et al.

[11] 4,062,744

[45] Dec. 13, 1977

[54] EXTRACTION OF COPPER FROM SULFIDE ORES

[75] Inventors: Thomas A. Henrie, Silver Spring, Md.; Roald E. Lindstrom, Reno; Kenneth P. V. Lei, Sparks, both of Nev.

[73] Assignee: The United States of America as represented by the Secretary of the Interior, Washington, D.C.

[21] Appl. No.: 706,103

[22] Filed: July 16, 1976

[51] Int. Cl.[2] ..... C25C 1/12; C25C 7/00

[52] U.S. Cl. ..... 204/106; 204/124; 204/250

[58] Field of Search ..... 204/106, 124, 115, 250, 204/268

[56] References Cited

U.S. PATENT DOCUMENTS

| | | | |
|---|---|---|---|
| 1,014,061 | 1/1912 | Hess | 204/106 |
| 2,389,691 | 11/1945 | Schumacher et al. | 204/124 |
| 3,788,965 | 1/1974 | Holsinger | 204/106 |

FOREIGN PATENT DOCUMENTS

| | | | |
|---|---|---|---|
| 1,060,150 | 6/1959 | Germany | 204/124 |

*Primary Examiner*—T. M. Tufariello

*Attorney, Agent, or Firm*—William S. Brown; Donald A. Gardiner

[57] ABSTRACT

Copper is extracted from sulfide ores or concentrates by electrolysis in a cell having separate anode and cathode sections, and having an intermediate liquid copper-mercury alloy electrode between the anode and cathode sections.

4 Claims, 1 Drawing Figure

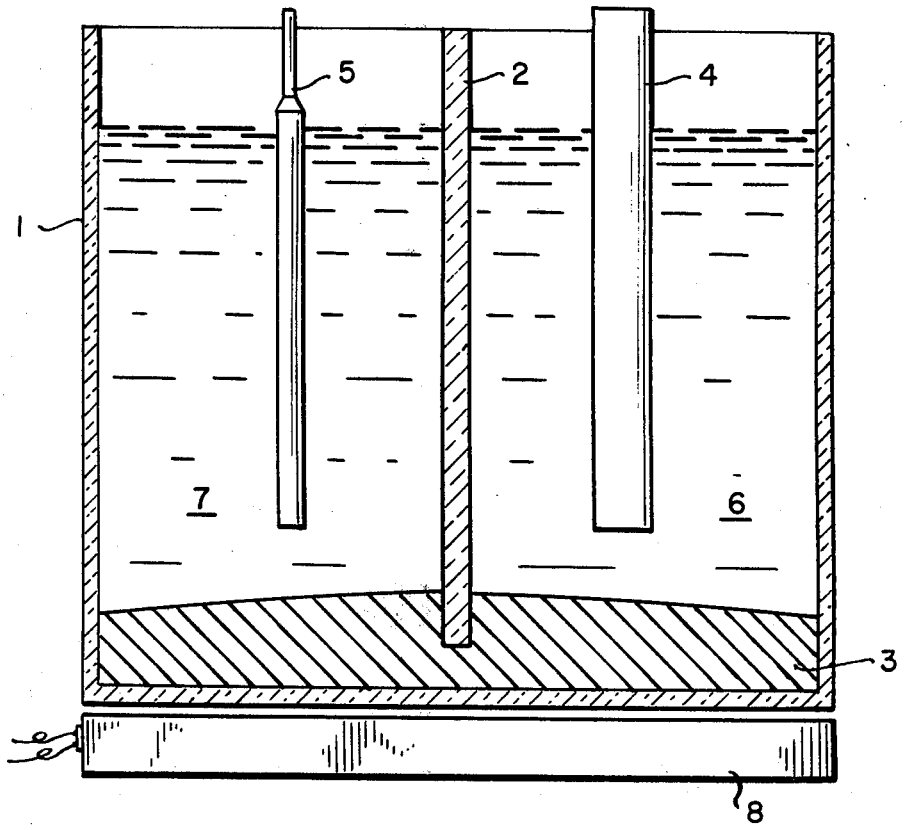
5
2
4
1
7
6
3
8

EXTRACTION OF COPPER FROM SULFIDE ORES

Copper is one of the most important industrial metals, and many prior art methods for recovery of the metal from its ores have been used or described in the literature. Most of these have, however, been relatively inefficient or have resulted in undesirable pollution of the environment.

We have now found, according to the method of the invention, that copper can be extracted from copper sulfide materials, particularly copper sulfide ores, minerals or concentrates, efficiently and without environmental pollution, by means of an electrolytic process employing an intermediate copper-mercury alloy electrode between separate anode and cathode sections. This process will be generally described with reference to the FIGURE which illustrates digrammatically an embodiment of an apparatus suitable for use in the process.

Referring to the FIGURE, the electrolytic cell consists of container 1, impervious barrier 2, intermediate Cu-Hg alloy electrode 3, anode 4, cathode 5, anode section 6, cathode section 7 and heat source 8. The container may consist of any material conventially used for electrolytic cells, provided it is substantially inert and durable with respect to the Cu-Hg alloy at the operating temperature.

The impervious barrier serves to divide the cell into cathode and anode sections and is, therefore, essentially impervious to ions present or formed in either anode or cathode section during electrolysis. Generally, glass is suitable for this purpose, but other materials wich as Teflon (tetrafluoroethylene), wood, or any material that is capable of withstanding the chemical environment may also be used. In addition, the specific form or structure of the barrier is not critical, provided only that it serves to divide the cell into anode and cathode compartments of appropriate dimensions.

The intermediate electrode consists of a copper-mercury alloy containing about 4 to 14 weight percent copper. It is maintained, by conventional means, at an operating temperature sufficient to maintain the allow in the liquid state, e.g., about 85° to 100° C, preferably about 90° to 95° C. The liquid alloy may be employed in any convenient arrangment in the cell, provided only that it serves to interconnect the anode and cathode sections of the cell. Generally, the most convenient arrangement will be that illustrated in the FIGURE in which the liquid alloy constitutes a layer on the bottom of the cell, with the impervious barrier being immersed in the alloy. The thickness of the alloy layer is not critical, provided it is sufficient for efficient transfer of metallic copper from the anode section to the cathode section, as more fully discussed below. Optimum thickness will depend on variables such as size and configuration of the cell, type and amount of copper ore or concentrate, composition of anolyte and catholyte, type of electrodes and operating temperature, and is best determined experimentally.

The electrodes employed are those conventionally employed in electrolytic processes involving copper deposition, e.g., electrowinning or electrorefining. Suitable anodes include graphite, $PbO_2$—coated graphite, $PbO_2$—coated lead, and other materials which are not consumed in the electrolysis. Suitable cathodes include stainless steel, copper, titanium, and other materials which will provide a good adherent surface for depositing copper. The electrodes may be employed in any conventional forms, such as plates, rods, etc., optimum forms and sizes being dependent on the above variables.

The anolyte consists of a suspension of the copper ore or concentrate in an aqueous electrolyte solution. Copper sulfide ores that may be treated according to the process of the invention include chalcopyrite, bornite, covellite and chalcocite. The ore is initially ground to a suitable particle size, e.g., minus-65 to plus-100 mesh, and slurried in the electrolyte solution, generally in an amount to provide a pulp density of about 6 to 12 percent. Concentrates of the ores, prepared by conventional processing operations such as gravity or flotation concentration, may also be used.

Suitable anodic electrolyte solutions are those conventionally employed in electrolytic processes for dissolution or deposition of copper. An acidic solution of cupric, ferrous and sulfate ions has been found to give particularly good results. Suitable sources of cupric ion include copper sulfate, copper chloride, and other copper salts, while ferrous ion may be supplied by ferrous sulfate and other ferrous salts. In addition, ferrous ion may be supplied by decomposition of the copper ore where an iron-containing ore, such as chalcopyrite, is employed. Sulfuric acid is generally preferred for providing the required acidity, although other acids such as hydrochloric and nitric acids may be used. Sources of sulfate ion include sulfuric acid, copper or iron sulfates and oxidation of sulfide resulting from decomposition of the ore. Where the ore contains sufficient iron, the use of sulfuric acid alone as the anolyte solution may give satisfactory results.

Optimum concentrations of cupric, ferrous and sulfate ions, and optimum pH of the electrolyte solution, will again depend on the above variables, but generally cupric ion concentrations in the range of about 2 to 20 g/l, ferrous ion in the range of about 4 to 40 g/l and sulfate ion in the range of about 12 to 100 g/l, with a pH of about 0.5 to 1.5, are satisfactory.

The catholyte consists of an aqueous electrolyte solution capable of providing efficient deposition of copper at the cathode, as well as enhancing formation of a good plating surface. These solutions are also conventional and will generally consist of an aqueous solution of a copper salt such as copper sulfate or copper chloride. Again, optimum concentrations are best determined empirically, but a copper ion concentration of about 30 to 60 g/l is generally satisfactory. Acidity of the solution is generally not critical, but the preferred pH will generally be in the range of about 0.5 to 1.5. Suitable acidity may be provided by addition of an acid such as sulfuric, hydrochloric or nitric acid.

Electroylsis is accomplished by means of a d.c. current from a conventional source. Suitable voltages and current densities will generally be in the range of about 7 to 15 volts and 4,320 to 12,240 amp/in$^2$, respectively. Time required may vary considerably with the above-discussed variables, but a period of about 5 to 170 hours will usually be sufficient for substantial decomposition of the ore and deposition of metallic copper at the cathode.

Operation of the process of the invention is based on the ready formation of a liquid alloy of copper and mercury, which is used as an intermediate electrode separating anode and cathode sections of the electrolytic cell. Mass transfer between anode section and cathode section is by means of copper atoms as a component of the liquid alloy. Copper ions, produced by electrolytic decomposition of the ore, are reduced at the intermediate electrode-anolyte interface, migrate through the intermediate electrode and are reoxidized at the intermediate electrode-catholyte interface. Electrons to maintain electrical balance are transferred in the opposite direction through the intermediate electrode.

This separation of the anolyte and catholyte by a metallic system substantially eliminates ionic flow between anolyte and catholyte sections, thereby permitting the use of different components in the anolyte and catholyte sections. Thus, the anolyte section may contain cations and anions that enhance decomposition of the ore and dissolution of copper, while the catholyte may contain components best suited to formation of copper plate at the cathode. At the same time, because of the high solubility of copper in mercury, as compared to that of iron, at the operating temperature, selective migration of copper from the anolyte, through the intermediate electrode, to the catholyte occurs, separation of copper and iron thereby being achieved.

The process of the invention may result in some transfer of mercury to the cathode deposit; however, a separation of mercury and copper can be easily achieved by distillation or electrolysis. For example, electrolysis in a $CuSO_4$ solution has been found to produce copper of 99.94 percent purity.

The process of the invention may be carried out in batch operations, or in continuous operations in which the anolyte slurry and the catholyte are continuously circulated into the cell from digestion tanks and returned to the digestion tanks through overflow systems. Continuous operation is generally more efficient for large scale processes and, additionally, is readily adapted to removal of excessive amounts of iron, elemental sulfur, sulfide ion or sulfate ion that may accumulate in the anolyte during the course of electrolysis.

In addition, the process of the invention is not limited to the use of single compartmented cells of the type illustrated in the FIGURE, but may employ multicompartmented cells with anode and cathode assemblies arranged alternately.

The invention will be more specifically illustrated by the following examples.

EXAMPLE 1

24 g CuS containing 67.4 percent Cu was slurried with 0.1 liter of a mixed solution of $CuSO_4$ and $FeCl_2$ containing 16.5 g/l copper and 41.2 g/l Fe. The slurry was electrolyzed in a cell of the type illustrated in the FIGURES for 7 amp-hr with a cathode current density of 48 amp/ft$^2$ and 7.9 volts. The intermediate Hg-Cu electrode containing 4 percent Cu and 96 percent Hg was heated and maintained at a temperature of 95° C by means of a hotplate. The catholyte was 0.15 liter of $CuSO_4$ solution containing 30.6 g/l Cu. Deposits of 5 g were obtained which contained 14 percent Hg. After electrolysis, the anolyte contained 16.0 g/l Cu, and the catholyte contained 40.2 g/l Cu. 6.3 g of CuS residue was recovered which contained 61.1 percent Cu.

Results of this experiment show that 76 percent of the copper was leached from the CuS source material in a mixed $CuSO_4$—$FeCl_2$ anolyte and deposited from the $CuSO_4$ catholyte solution after migration through the liquid copper-mercury alloy intermediate electrode. Iron was excluded from the catholyte by the intermediate electrode.

EXAMPLE 2

10 g chalcopyrite containing 19.8 percent Cu and 24 percent S was slurried with 0.49 liter of a mixed solution of $CuSO_4$ and $FeSO_4$ containing 16 g/l Cu and 43 g/l Fe. The slurry was electrolyzed in the cell of example 1 for 9.5 amp-hr with a cathode current density of 40 amp/ft$^2$ and 7.1 volts. The intermediate Hg-Cu electrode containing 14 percent Cu and 86 percent Hg was heated and maintained at 92° C during electrolysis. The catholyte volume was 0.22 liter containing 31 g/l C. 6 g of deposit was obtained which contained 12 percent Hg. 5.5 g residue was separated from the anolyte slurry, and it contained 0.23 percent Cu and 26.8 percent sulfur with 1.92 percent as free S. After electrolysis, the anolyte contained 12 g/l Cu and 46 g/l Fe, and the catholyte contained 24 g/lCu.

Results of this experiment show that 99 percent of the copper was leached from the chalcopyrite source material in a Cu-Fe sulfate anolyte and deposited from the $CuSO_4$ catholyte solution after migration through the liquid copper-mercury allow intermediate electrode. Co-migration of iron was nil.

EXAMPLE 3

10 g chalcopyrite containing 19.8 percent Cu and 24 percent S was slurried with 0.11 liter of a mixed solution of $CuSO_4$ and $FeCl_2$ containing 7.4 g/l Cu and 16 g/l Fe. The slurry was electrolyzed in the cell of example 1 for 10 amp-hr with a current density of 60 amp/ft$^2$ and 7.5 volts. The intermediate Hg-Cu electrode contained 14 percent Cu and 86 percent Hg which was maintained at 95° C. The catholyte was 0.24 liter of $CuSO_4$ solution containing 24 g/l of Cu. Four grams of deposit was obtained which contained 18 percent Hg. The chalcopyrite residue after electrolysis contained 0.27 percent Cu.

Results of this experiment show that 98 percent of the copper was leached from the chalcopyrite source material in a mixed $CuSO_4$—$FeCl_2$ anolyte, and copper was deposited from a $CuSO_4$ catholyte solution, while iron was excluded from the catholyte by the intermediate electrode.

EXAMPLE 4

1,065 g chalcopyrite containing 19.8 percent Cu, 22 percent Fe, and 24 percent S was slurried in 10 liters of acid sulfate solution containing 20 g/l Cu and 31 g/l Fe and having a pH of 1.2. The catholyte was 10 liters of cupric sulfate solution containing 100 ml $H_2SO_4$, 46 g/l Cu, and 1.5 g/l Fe. Both the anolyte slurry and the catholyte were circulated through the respective anode and cathode compartments of a three-cell system having $PbO_2$ anode assemblies and copper cathodes arranged alternately. Compartments were separated by a pool of 31 pounds of the liquid alloy of copper and mercury containing 4 percent copper and 96 percent mercury heated and maintained at 90° C. Electrolysis was made in each cell with an average current of 24 amperes and voltage of 11 for 342 ampere hours. The average anodic current density per cell was 73 amp/ft$^2$, and the average initial current density per cell was 82 amp/ft$^2$. 285 g of cathode products were obtained which contained 23.7 percent Hg and 0.03 percent Fe. 569g of anode residue was recovered which contained 2.1 percent Cu. The anolyte contained 15 g/l Cu, 42 g/l Fe, and the catholyte contained 41 g/l Cu, 5 g/l Fe after the electrolysis.

Results of this experiment show that 94 percent of the copper was leached from the chalcopyrite source material in a $CuSO_4$—$FeSO_4$ anolyte while the slurry flowed into and out of the electrolytic cell. Extracted copper was deposited on the cathodes. Coextracted iron was essentially excluded from the catholyte by the liquid Cu-Hg alloy.

EXAMPLE 5

550 g of chalcopyrite containing 19.8 percent Cu, 24 percent S, 22 percent Fe was slurried with 8 liters of sulfuric acid solution having a pH of 0.9. The catholyte was 6.6 liters of acidified copper sulfate solution (pH= 1.1) which contained 61 g/l Cu and 1.1 g/l Fe. The anolyte slurry and catholyte were circulated through the respective compartments of a two-cell system having a $PbO_2$ anode assembly sandwiched between two copper cathodes. The Cu-Hg alloy immediate electrode weighed 33 pounds and contained 4.5 percent Cu and 95.5 percent Hg. Its temperature was maintained at 91° C. Electrolysis was made with an average voltage of 15 volts and 12 amperes per cell for 700 amp-hr. The average anodic current density per cell was 55 amp/ft$^2$, and the initial cathode current density per cell was 31 amp/ft$^2$. 297 g cathode product was obtained which contained 14 percent Hg and 0.03 percent Fe. 220 g of the anode residue was recovered which contained 12.1 percent Cu. The anolyte after the deposition contained 1.1 g/l Cu and 10.6 g/l Fe, and the catholyte contained 35 g/l Cu and 0.8 g/l Fe.

Results of this experiment show that 76 percent of the copper was leached from the chalcopyrite shource material in a dilute $H_2SO_4$ anolyte solution and was deposited onto a cathode while the anolyte slurry and catholyte solution circulated into and out of the electrolytic cell. Iron co-deposition on the cathode was nil.

We claim:

1. A process for recovery of copper from sulfide ores or concentrates comprising providing an electrolytic cell consisting essentially of (1 ) an anode section containing an aqueous electrolyte slurry of the ore or concentrate, (2) a separate cathode section, and (3) an intermediate electrode consisting essentially of a liquid copper-mercury alloy at a temperature of about 85° to 100° C between said anode section and said cathode section, and operating said cell for a time sufficient to effect substantial decomposition of the ore or concentrate at the anode and deposition of metallic copper at the cathode.

2. The process of claim 1 in which the ore is chalcopyrite.

3. The process of claim 1 in which the intermediate electrode alloy contains about 4 to 14 weight percent copper.

4. The process of claim 1 in which the intermediate electrode is maintained at a temperature of about 90° to 95° C.

* * * * *